United States Patent [19]

Regalbuto et al.

[11] 4,298,063

[45] Nov. 3, 1981

[54] METHODS AND APPARATUS FOR SEVERING CONDUITS

[75] Inventors: John A. Regalbuto; Glenn B. Christopher, both of Forth Worth, Tex.

[73] Assignee: Jet Research Center, Inc., Arlington, Tex.

[21] Appl. No.: 123,225

[22] Filed: Feb. 21, 1980

[51] Int. Cl.[3] ..... E21B 29/02

[52] U.S. Cl. ..... 166/55; 102/308; 102/320; 166/297

[58] Field of Search ..... 166/55, 55.1, 297; 175/4, 4.5, 4.51, 4.52, 4.53; 102/254, 244, 260, 221, 21.6, 24 HC, 20, 21

[56] References Cited

U.S. PATENT DOCUMENTS 3,057,295 10/1962 Christopher ..... 166/55

4,184,430 1/1980 Mock ..... 102/24 R

*Primary Examiner*—William F. Pate, III

*Attorney, Agent, or Firm*—Thomas R. Weaver; John H. Tregoning; C. Clark Dougherty, Jr.

[57] ABSTRACT

Apparatus for severing a conduit along a plane extending transversely through the conduit which includes an elongated housing forming a pair of longitudinally spaced-apart fuel chambers communicated by an impingement passage extending longitudinally between the fuel chambers. A plurality of fuel reaction products discharge nozzles are disposed transversely through the sides of the housing and means are attached to the housing for simultaneously igniting fuel contained in the fuel chambers whereby reaction products formed therefrom travel in opposite directions through the impingement passage and exit the housing by way of the discharge nozzles. Methods of severing conduits using the apparatus are also provided.

38 Claims, 13 Drawing Figures

METHODS AND APPARATUS FOR SEVERING CONDUITS

This invention relates to methods and incendiary apparatus for completely severing a conduit from a selected location inside the conduit. The methods and apparatus of this invention are useful in a variety of applications including, but not limited to, the in situ severing of metal conduits used in drilling and completing oil wells and the like at selected downhole locations. For example, metal conduits such as drill strings, casing, tubing, etc., sometimes become lodged in a well bore below ground level and cannot be retracted from the well bore without damage to and/or loss of substantial parts of the conduit. In such instances, it has been the practice to lower a cutting tool into the conduit to the location of the obstruction, and to there cut or sever the conduit in order to free at least the upper portion of the conduit.

A variety of conduit cutting tools have been developed and used heretofore. Such tools generally fall into three categories, i.e., those of the mechanical milling or cutting type, those which utilize one or more explosive charges, and those which utilize chemicals such as a halogen fluoride. The mechanical type of conduit cutter is not only difficult to use but is very time consuming in achieving a cut. Cutting tools which include explosive charges bring about a quick severing of conduit, but such tools cause an often undesirable bulge or flare in the conduit at the location of severance and in some instances create shock waves which are sufficient to cause undesirble damage to surrounding structure. While chemical cutters can achieve a flare-free cut, they generally will not operate successfully in a conduit which does not contain fluid above the point where the cut is to be made.

Torches of the incendiary type have been developed and utilized heretofore for cutting objects such as heavy steel plate, cable and chain above and below water. An example of such a torch is described in U.S. Pat. No. 3,713,636 to Helms et al. dated Jan. 30, 1973 and in paper "D3" entitled "Jet Cutting of Metals with Pyronol Torch" by A. G. Rosner and H. H. Helms, Jr. presented at the 4th International Symposium on Jet Cutting Technology, Apr. 12–14, 1978. While the torch described in the abovementioned patent and paper can be utilized for severing relatively thick objects formed of metal or other material, it is unsuitable for severing conduits or tubular members in a plane transverse thereto at a desired location from within the conduit or tubular member.

By the present invention methods and apparatus for severing a conduit at a desired location from within the conduit are provided which achieve an extremely fast, clean cut by incendiary means without bulging or flaring the conduit. The methods and apparatus of the present invention can be efficiently utilized for severing tubular members of a broad range of size and wall thickness including tubular members formed of stainless steel. The apparatus operates efficiently in high temperature and pressure environments, e.g., 600° F. and 25,000 psi in air or when immersed in liquids such as water, drilling mud, etc. After operation, the entire apparatus is retrieved and reused and no debris is left in the severed tubular member or conduit.

The apparatus of the present invention for severing a conduit or tubular member along a plane extending transversely therethrough is comprised of an elongated housing adapted to be removably positioned within the conduit or tubular member. The housing forms an internal confined pair of longitudinally spaced-apart fuel chambers communicated by an impingement passage extending longitudinally between the fuel chambers. A plurality of fuel reaction products discharge nozzles communicated with the impingement passage are disposed transversely through the sides of the housing and means are attached to the housing for simultaneously igniting an incendiary fuel contained in the fuel chambers whereby the reaction products formed therefrom travel in opposite directions through the impingement passage and exit the housing transversely by way of the discharge nozzles. In using the apparatus, it is positioned within a conduit or a tubular member with the discharge nozzles of the housing in the desired plane of severance of the tubular member or conduit whereupon the fuel is ignited resulting in the production of extremely high temperature, high density reaction products which are directed against the interior wall surfaces of a conduit or tubular member at high velocity in a plane transverse to the conduit or tubular member causing the extremely rapid and flare-free severance thereof.

The term "conduit" is used hereinafter to mean tubular members of all types which are susceptible to internal cutting including, but not limited to, tubular goods utilized in oil, gas and water wells such as casing, tubing, drill pipe, etc., structural members, pipelines and other tubular members formed of metal, ceramic, plastic or the like.

In the drawings forming a part of this disclosure:

Figure 1:
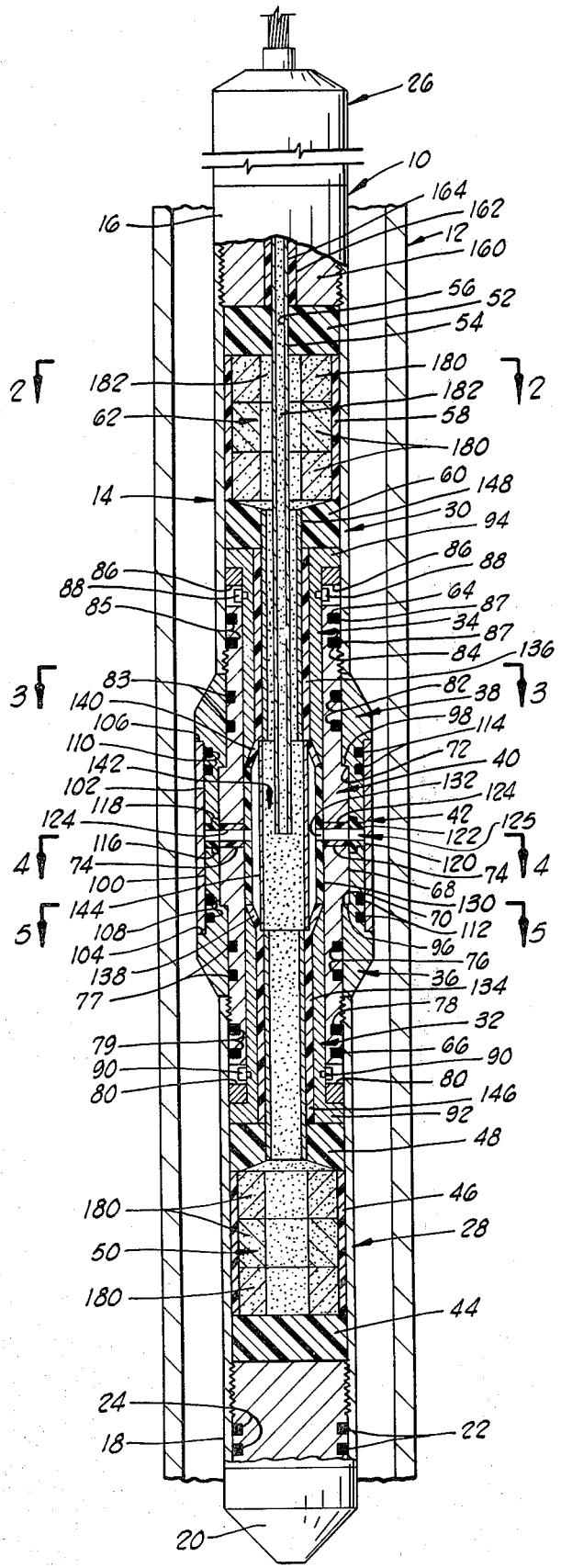
FIG. 1 is a vertical sectional view of one form of the apparatus of the present invention positioned within a conduit to be severed.
Figure 2:
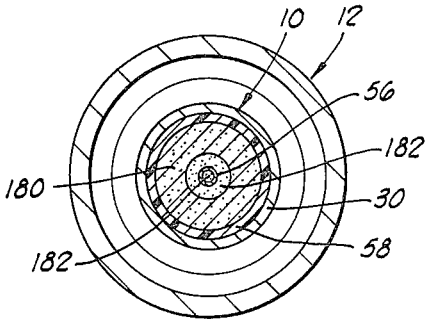
FIG. 2 is a sectional view taken along line 2—2 of FIG. 1.
Figure 3:
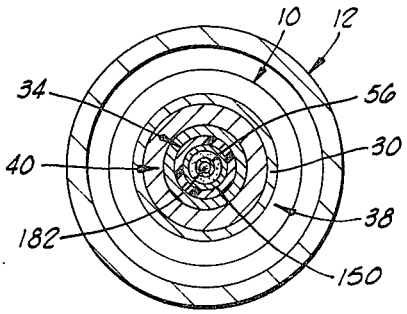
FIG. 3 is a sectional view taken along line 3—3 of FIG. 1.

Referring now to the drawings, and particularly to FIGS. 1–12, one form of the conduit severing apparatus of the present invention is illustrated and generally designated by the numeral 10. In FIG. 1 the apparatus 10 is illustrated positioned in a vertically disposed conduit 12 to be severed.

The apparatus 10 includes an elongated cylindrical housing, generally designated by the numeral 14, having an upper end 16 and a lower end 18. The lower end 18 of the housing 14 is closed by a plug 20 which is threadedly connected thereto. A pair of conventional O-rings 22 positioned in annular grooves 24 in the plug 20 provide a fluid-tight seal between the plug 20 and the housing 14. The upper end 16 of the housing 14 is closed by an ignition and wireline connector assembly generally designated by the numeral 26 which will be described in detail hereinbelow.

The housing 14 is comprised of identical lower and upper end sleeves 28 and 30, identical lower and upper bushing members 32 and 34, identical lower and upper outer nozzle members 36 and 38, a tandem nozzle member 40 and an outer seal member 42, all of which are sealingly assembled together. Positioned directly above and in contact with the plug 20 within the lower end sleeve 28 is a removable fuel chamber plug 44 formed of a heat resistant material such as graphite or a ceramic material. A cylindrical fuel chamber liner 46 formed of heat resistant material is removably disposed directly above the plug 44 and a cylindrical fuel chamber nozzle 48 formed of heat resistant material is removably positioned above the liner 46. (The nozzle 48 is shown in perspective in FIG. 10.) The plug 44, liner 46 and nozzle 48 form a first fuel chamber generally designated by the numeral 50 of heat resistant material within the lower end sleeve 28 of the housing 14. In a like manner, positioned directly below the ignition and wireline connector assembly 26 within the upper end sleeve 30 of the housing 14 is a removable fuel chamber plug 52 formed of heat resistant material. The plug 52 includes a central opening 54 for admitting an ignition tube 56, the function of which will be described in detail below. Removably positioned below the fuel chamber plug 52 is a fuel chamber liner 58 formed of heat resistant material and a fuel chamber nozzle 60 formed of heat resistant material is removably positioned directly below the liner 58. The plug 52, liner 58 and nozzle member 60 form a second heat resistant fuel chamber generally designated by the numeral 62 within the upper end sleeve 30 of the housing 14 which is longitudinally aligned within the housing 14 with the first fuel chamber 50.

Figure 4:
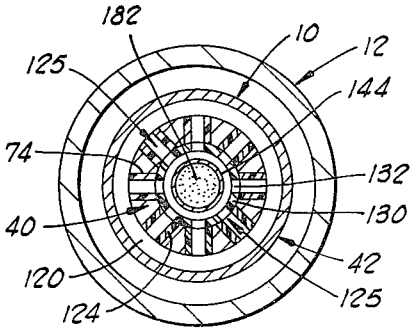
FIG. 4 is a sectional view taken along line 4—4 of FIG. 1.
Figure 5:
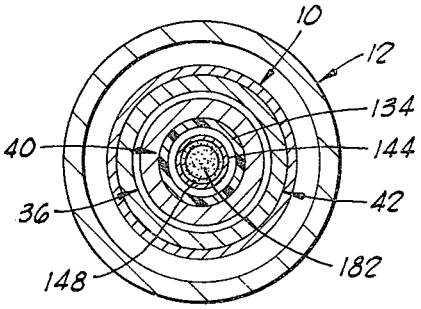
FIG. 5 is a sectional view taken along line 5—5 of FIG. 1.
Figure 6:
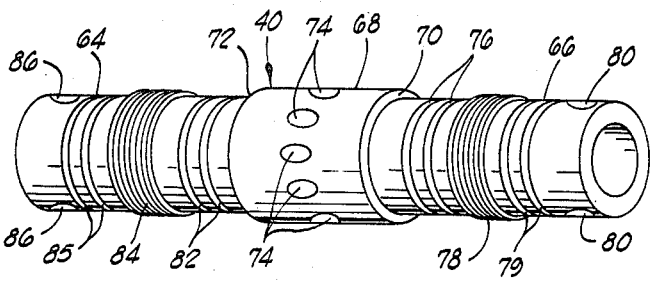
FIG. 6 is a perspective view of an element of the apparatus of FIG. 1 having reaction product discharge nozzles formed therein.

The tandem nozzle member 40 (shown in perspective in FIG. 6) is threadedly connected at an end portion 64 thereof to the lower end of the upper end sleeve 30 and at the other end portion 66 thereof to the upper end of the lower end sleeve 28. As best shown in FIGS. 1 and 6, the tandem nozzle member 40 includes a central enlarged portion 68 which forms oppositely facing annular shoulders 70 and 72 on the member 40. As shown in FIGS. 1, 4 and 6, a plurality of spaced radial apertures 74 are disposed in the enlarged portion 68 of the member 40, all of which lie in a plane perpendicular to the axis and intermediate to the ends thereof. Positioned adjacent the shoulder 70 of the member 40 in the end portion 66 thereof are a pair of annular grooves 76 for receiving conventional O-rings 77. Threads 78 are positioned adjacent the grooves 76 for threadedly engaging the lower end sleeve 28 and a second pair of annular grooves 79 for receiving O-rings 81 are positioned adjacent the threads 78. A pair of openings 80, the purpose of which will be described below, are disposed adjacent the end of the end portion 66. In a like manner, a pair of annular grooves 82 for receiving conventional O-rings 83 are positioned in the end portion 64 of the member 40 adjacent the shoulder 72 thereof. The end portion 64 also includes threads 84, a second pair of annular grooves 85 for receiving O-rings 87 and a pair of opposed openings 86.

Figure 8:
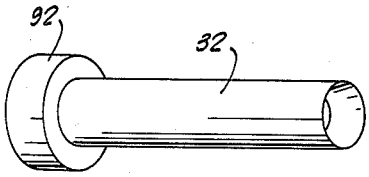
FIG. 8 is a perspective view of one of the bushing elements of the apparatus of FIG. 1.
Figure 10:
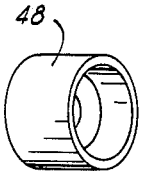
FIG. 10 is a perspective view of another liner element of the apparatus of FIG. 1.
Figure 11:
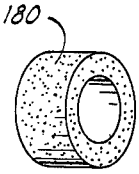
FIG. 11 is a perspective view of one of the incendiary fuel pellets of the apparatus of FIG. 1.

Internally removably disposed within the opposite end portions 64 and 66 of the tandem nozzle member 40 are the bushing members 34 and 32, respectively (the bushing member 32 is shown in perspective in FIG. 8). The bushing member 34 is held in place within the end portion 64 of the tandem nozzle member 40 by a pair of set screws 88 threadedly connected to the bushing member 34 at locations thereon whereby the heads of the set screws 88 are confined within the openings 86 in the member 40. In a like manner the bushing 32 is held within the end portion 66 of the member 40 by a pair of set screws 90, the heads of which are confined within the openings 80. As shown in FIGS. 1 and 8, each of the bushing members 32 and 34 include enlarged portions 92 and 94 at the ends thereof, respectively.

Figure 7:
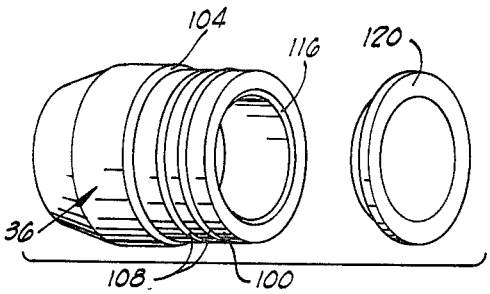
FIG. 7 is a perspective view of one of the outer sleeve elements and one of the insert elements of the apparatus of FIG. 1.

The lower and upper outer nozzle members 36 and 38 (the member 36 is shown in perspective in FIG. 7) fit in mirror image relationship over the tandem nozzle member 40. The outer nozzle member 36 includes an internal shoulder 96 which coacts with the shoulder 70 of the tandem nozzle member 40 to prevent the outer nozzle member 36 from moving upwardly (FIG. 1). The bottom of the outer nozzle member 36 abuts the top of the lower end sleeve 28 which prevents it from moving downwardly. The upper outer nozzle member 38 includes an internal shoulder 98 which coacts with the shoulder 72 of the tandem nozzle member 40 to prevent the outer nozzle member 38 from moving downwardly and the top of the member 38 abuts the upper end sleeve 30 which prevents it from moving upwardly. As best shown in FIG. 1, the outer nozzle members 36 and 38 are spaced apart whereby an annular opening is formed between the members 36 and 38 adjacent the apertures 74 in the tandem nozzle member 40. As shown in FIGS. 1 and 7, the outer nozzle members 36 and 38 include outer recessed end portions 100 and 102, respectively, which form shoulders 104 and 106, respectively, thereon. A pair of annular grooves 108 for receiving O-rings 112 are disposed in the portion 100 of the outer nozzle member 36 and a pair of annular grooves 110 for receiving O-rings 114 are provided in the portion 102 of the outer nozzle member 38. The outer seal member 42 is cylindrical and is positioned around and over the portions 100 and 102 of the members 36 and 38 and O-rings 112 positioned within the grooves 108 of the member 36 and O-rings 114 positioned in the grooves 110 of the member 38 provide a fluid-tight seal between the outer seal member 42 and the members 36 and 38.

As shown in FIGS. 1, 4 and 7, the interior ends of the outer nozzle members 36 and 38 include counterbores 116 and 118, respectively. A pair of inserts 120 and 122 of L-shape in cross section and formed of heat resistant material are positioned adjacent the interior ends of the outer nozzle members 36 and 38, respectively.

A tubular member 124, formed of heat resistant material, is positioned in each of the apertures 74 of the tandem nozzle member 40, and as best shown in FIGS. 1 and 4, an insert member 130 formed of heat resistant material and having a plurality of apertures 132, formed therein is positioned within the tandem nozzle member 40. The apertures 132 in the insert 130 correspond in position with the openings in the tubular members 124 positioned within the apertures 74 of the tandem nozzle member 40.

As will now be understood, the apertures 132 in the insert member 130, the tubular members 124 disposed in the apertures 74 of the tandem nozzle member 40 and the annular space between the inserts 120 and 122 attached to the outer nozzle members 36 and 38 form reaction product discharge nozzles of heat resistant material positioned in a plane extending transversely to the axis of the housing 14, such nozzles being generally designated by the numeral 125.

Figure 9:
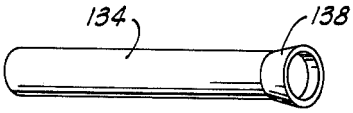
FIG. 9 is a perspective view of one of the liner elements of the apparatus of FIG. 1.

Positioned above and below the insert member 130 and in contact with the lower and upper ends thereof, respectively, are identical lower and upper liner members 134 and 136 (the liner member 134 being shown in perspective in FIG. 9). As shown best in FIGS. 1 and 9, each of the liner members 134 and 136 include a flared end portion 138 and 140, respectively, at the upper and lower ends thereof, respectively. As shown in FIG. 1, the lower end of the lower liner member 134 abuts the nozzle member 48 and the upper end of the upper liner member 136 abuts the nozzle member 60. The interior openings in the nozzle members 48 and 60, the lower and upper liner members 134 and 136, and the insert member 130 form a longitudinal impingement passage, generally designated by the numeral 142, communicated with the longitudinally aligned fuel chambers 50 and 62.

A fuel retainer tube 144 is disposed within the insert member 130 and between the flared end portions 138 and 140 of the lower and upper liner members 134 and 136, respectively, for retaining fuel within the impingement passage 142. Preferably also, identical lower and upper alignment tubes 146 and 148, respectively, are disposed within the liner members 134 and 136 and the openings in the nozzles 48 and 60, respectively, the fuel retaining tube 144 and alignment tubes 148 and 150, all preferably being formed of aluminum.

Figure 12:
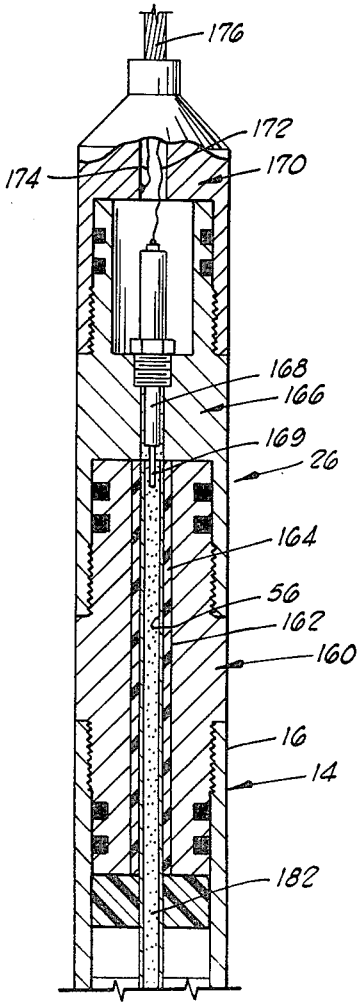
FIG. 12 is a vertical sectional view of the upper portion of the apparatus illustrated in FIG. 1.

Referring now to FIGS. 1 and 12, threadedly connected to the upper end of the upper end sleeve 30 and sealed by O-rings is the ignition and wireline connector assembly 26. The assembly 26 includes a fuse subassembly 160 having a longitudinal bore 162 extending therethrough. A tubular liner member 164 formed of heat resistant material is disposed within the longitudinal opening 162, and within the tubular liner member 164 is disposed the ignition tube 56, preferably formed of stainless steel. As shown in FIGS. 1 and 12, the ignition tube 56 extends from the top of the fuse subassembly 160 through the opening 54 in the plug 52, through the fuel chamber 62 and through the impingement passage 142 to a point adjacent the apertures 132 in the insert member 130.

Threadedly connected to the upper portion of the fuse subassembly 160 and sealed by O-rings is an ignition subassembly 166 having an electrical ignitor assembly 168 disposed therein. The ignitor assembly 168 can take various forms, but generally includes an ignition element 169 which projects into fuel disposed in the ignition tube 56. When electrically activated, the ignition element 169 of the ignitor 168 ignites the fuel.

Threadedly connected to the top portion of the ignition subassembly 166 and sealed by O-rings is a wireline connector subassembly 170. As will be understood by those skilled in the art, the wireline connector subassembly 170 includes electrical leads 172 and 174 which are connected in a conventional manner to the subassembly 170 and ignitor 168 and includes a wireline 176 attached thereto for lowering the apparatus 10 to a desired location within a conduit. The cable 176 carries the electrical leads 172 and 174 whereby the ignitor 168 can be electrically activated from a point on the surface or othewise outside the conduit to be severed.

Disposed within the fuel chambers 50 and 62, the impingement passage 142 and the ignition tube 56 is a solid non-explosive incendiary fuel, i.e., a fuel which upon ignition produces a strongly exothermic reaction whereby high temperature and high density reaction products are produced. While a variety of such fuels can be utilized in the apparatus 10, and the apparatus 10 is not limited to the use of any particular fuel composition, a particularly suitable fuel is a solid pyrotechnic fuel composition containing nickel and aluminum of the type described in U.S. Pat. No. 3,503,814 dated Mar. 31, 1970 to H. H. Helms and A. G. Rosner. As described in detail in the foregoing patent, such pyrotechnic composition contains nickel and aluminum and in addition may contain magnesium, ferric oxide or bismuth. The resulting powder mixture can be compressed into pellets and the pellets can be ignited by placing them in contact with loose powder of the same composition ignited by conventional heating elements or other ignition systems. Upon ignition an exothermic reaction occurs producing molten nickel and aluminum which proceeds without the inclusion of supporting oxygen. Since the reaction is initiated by heat, the fuel composition is non-explosive, i.e., insensitive to shock, impact and vibration whereby it can be safely handled, stored and used.

A particularly suitable pyrotechnic fuel composition for use in the apparatus of this invention is a composition of the type described in U.S. Pat. No. 3,695,951 dated Oct. 3, 1972 to H. H. Helms and A. G. Rosner. As more fully described in that patent, the fuel composition is comprised of nickel, a metal oxide, a component selected from the group consisting of aluminum and a mixture of aluminum and a metal selected from the group consisting of magnesium, zirconium, bismuth, beryllium, boron and mixtures thereof, provided that aluminum comprises at least 50% of the mixture, and a component which produces vapor upon heating. The composition reacts at a controlled rate and produces high temperature molten reaction products including gas.

The most preferred pyrotechnic composition of this type for use in accordance with this invention is a gas forming elemental mixture of nickel, aluminum, ferric oxide and powdered polytetrafluoroethylene wherein the polytetrafluoroethylene functions to produce a gas which forces the molten reaction products out of the apparatus 10 at a high velocity.

Referring again to the drawings, and particularly to FIGS. 1–5 and 11, the apparatus 10 most preferably includes one or more cylindrically shaped gas forming pyrotechnic fuel pellets 180 disposed in each of the fuel chambers 50 and 62, each of the cylindrical fuel pellets 180 being comprised of nickel present in an amount of about 17.8% by weight, aluminum present in an amount of about 24.6% by weight, ferric oxide present in an amount of about 48.5% by weight and polytetrafluoroethylene present in an amount of about 9.1% by weight. A powdered non-gas forming pyrotechnic fuel composition 182, i.e., excluding a gas forming component, is disposed in the fuel chambers 50 and 62 interiorly of the cylindrical fuel pellets 180 therein, within the impingement passage 142 and within the ignition tube 56. The powdered non-gas forming pyrotechnic fuel composition is preferably comprised of aluminum present in an amount of about 30.0% by weight and cupric oxide present in an amount of about 70.0% by weight.

In operation, the apparatus 10 is inserted into a conduit to be severed and positioned whereby the fuel reaction products discharge nozzles 125 thereof lie in the desired plane of severance of the conduit. In severing a vertically positioned conduit, such as a conduit disposed in a well bore, the apparatus 10 is lowered by means of the wireline 176 connected to the apparatus 10 within the conduit and positioned with the fuel reaction products discharge nozzles 125 in the desired plane of severance of the conduit. The ignitor 168 is then electrically activated whereby the heating element 169 thereof which extends into the powdered non-gas forming pyrotechnic fuel disposed within the ignition tube 56 is heated to a temperature which ignites the fuel. Upon ignition, the non-gas forming powdered fuel 182 within the ignition tube 56 reacts and the reaction travels downwardly within the ignition tube 56 to the end thereof and ignities the powdered fuel 182 disposed within the impingement passage 142 at a point midway between the fuel chambers 50 and 62. The reaction then proceeds in opposite directions within the impingement passage 142 simultaneously whereupon the powdered fuel within the fuel chambers 50 and 62 is reacted which in turn ignites the gas forming solid fuel pellets 180 within the fuel chambers 50 and 62. Upon the ignition of the gas forming fuel pellets, high velocity jets of high density, high temperature reaction products flow from the fuel chambers 50 and 62 in opposite directions back through the impingement passage 142. The high velocity jets collide or impinge within the impingement passage 142 adjacent the fuel reaction discharge nozzles 125 formed in the apparatus 10 and the pressure produced by the reaction of the fuel pellets ruptures the fuel retainer tube 144 whereby the reaction products discharge at a high velocity through the fuel reaction nozzles and burn through the outer seal member 42 in a plane normal to the axis of the apparatus 10. The high velocity jets of high temperature, high density reaction products flow through the fuel reaction discharge nozzles 125 and a 360° dispersal of the reaction products flows from the apparatus 10 into contact with the walls of the conduit, severing the conduit without bulging or flaring the conduit at the area of the cut. Upon completion of the reaction of the fuel within the apparatus 10 and the severing of the conduit the apparatus 10 is withdrawn from the conduit and no debris is left within the conduit. The apparatus 10 can be reused by replacing the parts affected by the fuel reaction, namely, the ignition tube 56, the fuel retainer tube 144, the outer seal member 42 and other parts which are damaged by the fuel reaction to the point whereby they cannot be reused, such as the alignment tubes 146 and 148.

Figure 13:
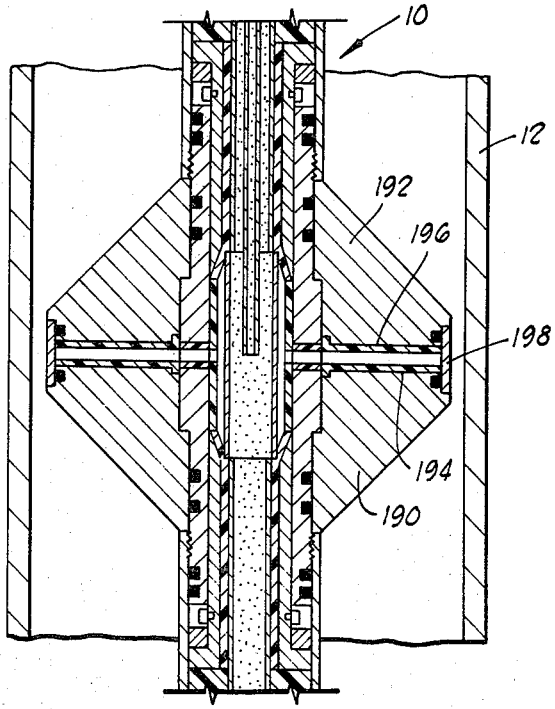
FIG. 13 is a vertical sectional view of the intermediate portion of an alternate form of apparatus of the present invention.

The apparatus 10 can be utilized to sever conduits of various sizes and various thicknesses. Typically, the apparatus 10 is formed in an elongated small diameter whereby the outside diameter of the largest portion thereof, i.e., the outside diameter of the outer nozzle members 36 and 38 is less than the inside diameter of the smallest conduit to be severed by the apparatus 10. As shown in FIG. 13, when the apparatus 10 is utilized for severing conduits of larger diameter, it is only necessary to replace the outer nozzle members 36 and 38 with nozzle members 190 and 192 having a larger external diameter. This also involves replacing the inserts 120 and 122 with larger inserts 194 and 196 and replacing the outer seal member 42 with a larger diameter seal member 198.

In order to insure severing of a conduit and in selecting the size of the outer nozzle members to be used, the ratio of the outside diameter of the outer nozzle members of the apparatus 10 to the inside diameter of the conduit to be severed should be a minimum of 0.87. The ratio of the outside diameter of the outer nozzle members to the inside diameter of the conduit can be greater than 0.87 so long as the apparatus 10 can be inserted in the conduit to be severed, i.e., the ratio can be as great as or slightly less than 1.

As will be understood by those skilled in the art, the greater the thickness of the conduit to be severed, the greater the quantity of gas forming pyrotechnic fuel required in the apparatus 10. In this regard, the quantity of gas forming pyrotechnic fuel contained in the fuel chambers 50 and 62 of the apparatus 10 can be varied by varying the number of cylindrical fuel pellets 180 contained therein. For example, the fuel chambers 50 and 62 can be sized to contain a maximum of a given number of fuel pellets each. When less than such given number of fuel pellets are used, one or more additional plugs 44 can be utilized within the lower end section 28 of the housing 14 and one or more additional plugs 52 can be utilized in the upper end section 30 of the housing 14 to reduce the sizes of the fuel chambers 50 and 62, respectively, whereby they contain the desired number of fuel pellets 180. Generally, the ratio of the weight of gas forming pyrotechnic fuel composition comprised of a solid mixture of nickel, aluminum, ferric oxide and polytetrafluoroethylene utilized in the apparatus 10 to the weight per foot of metal or other material in the conduit to be severed should be in the range of from about 0.32 to about 0.41. Preferably the ratio of the weight of such fuel to the weight per foot of material in the conduit to be severed is about 0.41.

In the assembly of the apparatus 10, the tubular members 124 are positioned in the apertures 74 of the tandem nozzle member 40 and retained therein by means of a suitable adhesive. The insert member 130 is next inserted within the tandem nozzle member 40 and the apertures 132 thereof are aligned with the openings formed by the tubular members 124. The bushing members 32 and 34 and liner members 134 and 136 are next inserted into the ends of the tandem nozzle member 40 with the fuel retainer tube 144 positioned therebetween. The set screws 88 and 90 are attached to the bushing members 34 and 32, respectively, for retaining the assembly together. The outer seal member 42 is next fitted over the outside of the tandem nozzle member 40 and the outer nozzle members 36 and 38 having the inserts 120 and 122 attached thereto by a suitable adhesive are positioned over the ends of the tandem nozzle member 40 in engagement with the outer seal member 42 as shown in FIG. 1. The end sleeves 28 and 30 are next threadedly connected to the tandem nozzle member 40 and the fuel chamber nozzle members 48 and 60 and alignment tubes 146 and 148 are inserted therein. The fuel chamber liner 46, cylindrical fuel pellets 180, fuel chamber plug 44 and plug 20 are inserted into and attached to the lower end sleeve 28. The fuel chamber liner 58 and cylindrical fuel pellets 180 are next inserted into the upper end sleeve 30 followed by the tamping of the powdered fuel into the interior of the cylindrical fuel pellets 180 in the fuel chamber 50, into the impingement passage 142 and into the interior of the cylindrical fuel pellets 180 in the fuel chamber 62. The ignition tube 56 is inserted in the impingement passage 142 and through the fuel chamber 62 as the powdered fuel is placed therein and the ignition tube 56 is also filled with powdered fuel. The plug 62 is next inserted into the upper end sleeve 30 over the ignition tube 56 and the fuse subassembly 160 is threadedly connected to the upper end sleeve 30 with the ignition tube and tubular liner member 164 extending therethrough. The ignitor subassembly 166 is next threadedly connected to the fuse subassembly 160 in the manner shown in FIG. 12 followed by the threaded connection of the wireline connector subassembly 170 thereto.

In order to facilitate a clear understanding of the methods and apparatus of the present invention, the following example is given.

EXAMPLE

An apparatus 10 having an overal length of 3 feet, a housing diameter at the lower and upper end sleeves 28 and 30 of 4 inches and an outside diameter at the outer seal member 42 of 4.25 inches is utilized to sever a conduit 12 having an internal diameter of 4.89 inches and a wall thickness of 0.304 inches. The conduit is formed of carbon steel and has a weight of 17 pounds per foot. Each of the fuel chambers 50 and 62 of the apparatus 10 contains 6 cylindrical gas forming pyrotechnic fuel pellets 180 comprised of 17.8% by weight nickel, 24.6% by weight aluminum, 48.5% by weight ferric oxide and 9.1% by weight polytetrafluoroethylene. Each of the fuel pellets 180 has a density of 3.17 gms/cc., an external diameter of 2 9/16 inches, an internal diameter of $\frac{3}{8}$ inch and a thickness of 1 inch. The total weight of the fuel pellets 180 in the fuel chambers 50 and 62 of the apparatus 10 is 7 pounds. Powdered non-gas forming fuel comprised of 30.0% by weight aluminum and 70.0% by weight cupric oxide is contained within the apparatus 10 in a total amount of 0.2 pound. The ignitor assembly 168 of the apparatus 10 is electrically activated causing the heating element 169 thereof to heat to a temperature of approximately 1220° F. whereby the powdered fuel contained within the ignition tube 56 is ignited. The fuel reaction goes to completion in 1 second during which time a high velocity, high temperature and high density 360° dispersal of reaction products exit the apparatus 10 causing the severance of the conduit 12.

What is claimed is:

1. Apparatus for severing a conduit along a plane extending transversely through the conduit comprising:

an elongated housing adapted to be removably positioned within said conduit, said housing forming a pair of longitudinally spaced-apart fuel chambers therewithin communicated by an impingement passage extending longitudinally between said fuel chambers and having a plurality of fuel reaction products discharge nozzles communicated with said impingement passage said discharge nozzles being located longitudinally intermediate said fuel chambers and disposed transversely through the sides of said housing; and means attached to said housing for simultaneously igniting solid non-explosive incendiary fuel contained in said fuel chambers whereby reaction products formed therefrom travel longitudinally in opposite directions through said impingement passage collide and exit said housing by way of said discharge nozzles.

2. The apparatus of claim 1 wherein said discharge nozzles lie in a single plane extending transversely to the axis of said housing.

3. The apparatus of claim 2 wherein said impingement passage is of reduced cross-sectional area as compared to the cross-sectional areas of said fuel chambers.

4. Apparatus for severing a conduit along a plane extending transversely through the conduit comprising:

an elongated housing adapted to be removably positioned within said conduit, said housing forming a pair of longitudinally spaced-apart fuel chambers therewithin communicated by a longitudinal passage extending between said fuel chambers and having a plurality of fuel reaction products discharge nozzles communicated with said longitudinal passage, said discharge nozzles being located longitudinally intermediate said fuel chambers and disposed transversely through the sides of said housing; and means attached to said housing and positioned within said passage for igniting non-gas forming pyrotechnic fuel contained in said passage which in turn ignites gas forming pyrotechnic fuel contained in said fuel chambers whereby reaction products formed from said gas forming pyrotechnic fuel travel in opposite directions through said longitudinal passage collide and exit said housing by way of said discharge nozzles.

5. The apparatus of claim 4 wherein said discharge nozzles all lie in a single plane positioned substantially midway between said fuel chambers and extending transversely to the axis of said housing.

6. The apparatus of claim 5 wherein said fuel chambers are of the same cross-sectional areas and said impingement passsage is of reduced cross-sectional area as compared to the cross-sectional areas of said fuel chambers.

7. Apparatus for severing a substantially vertically positioned conduit comprising:

an elongated cylindrical housing having closed upper and lower ends;

means connected to the upper end of said housing for lowering said housing to a location in said conduit;

a first fuel chamber in said housing positioned adjacent the lower end thereof;

a second fuel chamber in said housing positioned in longitudinal alignment with said first fuel chamber adjacent the upper end of said housing;

means in said housing forming a longitudinally positioned impingement passage between said first and second fuel chambers communicated with said fuel chambers;

a plurality of spaced radially extending discharge nozzles positioned between said first and second fuel chambers extending through said means forming said impingement passage and through said housing, said discharge nozzles all lying in a single plane extending transversely to the axis of said housing;

a solid non-gas forming pyrotechnic fuel composition disposed within said passage;

a solid gas forming pyrotechnic fuel composition disposed in said first and second fuel chambers positioned in ignition contact with said non-gas forming fuel within said passage; and remotely operable fuel ignition means positioned in said passage for igniting said non-gas forming fuel composition therein.

8. The apparatus of claim 7 which is further characterized to include means for retaining said fuel composition in said impingement passage and in said first and second fuel chambers disposed in said passage adjacent said discharge nozzles.

9. The apparatus of claim 8 which is further characterized to include means for sealing said discharge nozzles attached to said housing.

10. The apparatus of claim 7 wherein said first and second fuel chambers are cylindrical and of the same cross-sectional area and said impingement passage is cylindrical and of reduced cross-sectional area as compared to the cross-sectional areas of said first and second fuel chambers.

11. The apparatus of claim 10 wherein said means for igniting said non-gas forming pyrotechnic fuel composition in said impingement passage comprises:

an elongated ignition tube disposed in said housing having an upper end and an open lower end and extending from a point adjacent the closed upper end of said housing through said second fuel chamber and through said impingement passage to a point adjacent said discharge nozzles;

a solid non-gas forming pyrotechnic fuel composition disposed within said ignition tube; and means for remotely igniting said non-gas forming pyrotechnic fuel composition in said ignition tube attached to the upper end thereof and to said housing.

12. The apparatus of claim 11 wherein said first and second fuel chambers, said impingement passage and said discharge nozzles are lined with heat resistant material.

13. A method for severing a conduit along a plane extending transversely through the conduit comprising the steps of:

confining a solid non-explosive incendiary fuel in a pair of longitudinally spaced-apart fuel chambers formed in an elongated housing sized for insertion in said conduit, said housing including a longitudinally extending impingement passage communicating said fuel chambers and a plurality of spaced radially extending fuel reaction products discharge nozzles communicating with said passage and positioned in a plane longitudinally intermediate said fuel chambers extending transversely to the axis of said housing;

positioning said housing inside said conduit with said fuel reaction products discharge nozzles in the desired plane of severance of said conduit; and simultaneously igniting said incendiary fuel confined in each of said fuel chambers so that reaction products formed therefrom travel longitudinally in opposite directions through said impingement passage collide and exit said housing by way of said discharge nozzles.

14. The method of claim 13 wherein the cross-sectional area of said impingement passage in said housing is less than the cross-sectional areas of said fuel chambers therein.

15. The method of claim 14 wherein said incendiary fuel is a solid pyrotechnic composition comprised of a mixture of nickel, aluminum, ferric oxide and polytetrafluoroethylene.

16. The method of claim 15 wherein the ratio of the weight of said incendiary fuel confined in said housing to the weight per foot of metal in the conduit to be severed is in the range of from about 0.32 to about 0.41.

17. The method of claim 16 wherein the ratio of the outside diameter of said housing at the location of said fuel reaction products discharge nozzles therein to the inside diameter of said conduit is in the range of from about 0.87 to slightly less than 1.

18. A method of severing a conduit along a plane extending transversely through the conduit comprising the steps of:

confining a gas forming pyrotechnic fuel composition in a pair of longitudinally spaced-apart fuel chambers and confining a non-gas forming pyrotechnic fuel composition in a longitudinal impingement passage communicated with said fuel chambers formed in an elongated cylindrical housing sized for insertion in said conduit, said housing including a plurality of spaced radially extending fuel reaction products discharge nozzles communicated with said impingement passage and positioned in a plane longitudinally intermediate said fuel chambers extending transversely to the axis of said housing;

positioning said housing inside said conduit with said fuel reaction products discharge nozzles in the desired plane of severance of said conduit; and igniting said non-gas forming fuel composition at a point in said impingement passage adjacent said discharge nozzles so that said non-gas forming fuel composition is reacted and simultaneously ignites said gas forming fuel composition in said fuel chambers whereby the reaction products formed from said gas forming fuel composition travel longitudinally in opposite directions through said impingement passage collide and exit said housing by way of said discharge nozzles.

19. The method of claim 18 wherein said fuel chambers are of the same cross-sectional area and the cross-sectional area of said impingement passage is less than the cross-sectional areas of said fuel chambers.

20. The method of claim 19 wherein said gas forming pyrotechnic fuel composition is a solid composition comprised of nickel, aluminum, ferric oxide and polytetrafluoroethylene.

21. The method of claim 20 wherein nickel is present in said composition in an amount of about 17.8% by weight of said composition, aluminum is present therein in an amount of about 24.6% by weight of said composition, ferric oxide is present therein in an amount of about 48.5% by weight of said composition and polytetrafluoroethylene is present therein in an amount of about 9.1% by weight of said composition.

22. The method of claim 21 wherein the ratio of the weight of said gas forming pyrotechnic fuel composition confined in said housing to the weight per foot of metal in the conduit to be severed is in the range of from about 0.32 to about 0.41.

23. The method of claim 22 wherein the ratio of the outside diameter of said housing at the location of said fuel reaction products discharge nozzles therein to the inside diameter of said conduit to be severed is in the range of from about 0.87 to slightly less than 1.

24. The method of claim 23 wherein said non-gas forming pyrotechnic fuel composition is a solid composition comprised of aluminum and cupric oxide.

25. The method of claim 24 wherein aluminum is present therein in an amount of about 30.0% by weight of said composition and cupric oxide is present therein in an amount of about 70.0% by weight of said composition.

26. A method of severing a downhole well conduit comprising the steps of:

confining a solid non-explosive incendiary fuel in a pair of longitudinally spaced-apart fuel chambers formed in an elongated cutting tool sized for insertion in said conduit, said cutting tool including a longitudinally extending impingement passage communicating said fuel chambers and a plurality of spaced radially extending fuel reaction products discharge nozzles communicating with said passage and positioned in a plane longitudinally intermediate said fuel chambers extending transversely to the axis of said cutting tool;

lowering said cutting tool through said conduit to a position therein where it is desired to sever said conduit;

simultaneously igniting said incendiary fuel confined in each of said fuel chambers so that reaction products formed therefrom travel longitudinally in opposite directions through said impingement passage, collide and exit said cutting tool by way of said discharge nozzles and sever said conduit; and withdrawing said cutting tool from said conduit.

27. The method of claim 26 wherein the cross-sectional area of said impingement passage in said cutting tool is less than the cross-sectional areas of said fuel chambers therein.

28. The method of claim 27 wherein said incendiary fuel is a solid pyrotechnic fuel composition comprised of a mixture of nickel, aluminum, ferric oxide and polytetrafluoroethylene.

29. The method of claim 28 wherein the ratio of the weight of fuel composition confined in said cutting tool to the weight per foot of metal in the conduit to be severed is in the range of from about 0.32 to about 0.41.

30. The method of claim 29 wherein the ratio of the outside diameter of said cutting tool at the location of said fuel reaction products discharge nozzles therein to the inside diameter of said conduit is in the range of from about 0.87 to slightly less than 1.

31. A method of severing a downhole well conduit comprising:

confining a gas forming pyrotechnic fuel composition in a pair of longitudinally spaced-apart fuel chambers and confining a non-gas forming pyrotechnic fuel composition in a longitudinal impingement passage communicated with said fuel chambers formed in an elongated cylindrical cutting tool sized for insertion in said conduit, said cutting tool including a plurality of spaced radially extending fuel reaction products discharge nozzles communicated with said impingement passage and positioned in a plane longitudinally intermediate said fuel chambers extending transversely to the axis of said cutting tool;

lowering said cutting tool through said conduit to a position therein where it is desired to sever said conduit;

igniting said non-gas forming fuel composition at a point in said impingement passage adjacent said discharge nozzles so that said non-gas forming fuel composition is reacted and simultaneously ignites said gas forming fuel composition in said fuel chambers whereby the reaction products formed from said gas forming fuel composition travel longitudinally in opposite directions through said impingement passage, collide and exit said cutting tool by way of said discharge nozzles and sever said conduit; and withdrawing said cutting tool from said conduit.

32. The method of claim 31 wherein said fuel chambers are of the same cross-sectional area and the cross-sectional area of said impingement passage is less than the cross-sectional areas of said fuel chambers.

33. The method of claim 32 wherein said gas forming pyrotechnic fuel composition is a solid composition comprised of nickel, aluminum, ferric oxide and polytetrafluoroethylene.

34. The method of claim 33 wherein nickel is present in said composition in an amount of about 17.8% by weight of said composition, aluminum is present therein in an amount of about 24.6% by weight of said composition, ferric oxide is present therein in an amount of about 48.5% by weight of said composition and polytetrafluoroethylene is present therein in an amount of about 9.1% by weight of said composition.

35. The method of claim 34 wherein the ratio of the weight of said gas forming pyrotechnic fuel composition confined in said cutting tool to the weight per foot of metal in the conduit to be severed is in the range of from about 0.32 to about 0.41.

36. The method of claim 35 wherein the ratio of the outside diameter of said cutting tool at the location of said fuel reaction products discharge nozzles therein to the inside diameter of said conduit to be severed is in the range of from about 0.87 to slightly less than 1.

37. The method of claim 36 wherein said non-gas forming pyrotechnic fuel composition is a solid composition comprised of aluminum and cupric oxide.

38. The method of claim 37 wherein aluminum is present therein in an amount of about 30.0% by weight of said composition and cupric oxide is present therein in an amount of about 70.0% by weight of said composition.

* * * * *